US008903299B2

(12) United States Patent
Lee et al.

(10) Patent No.: US 8,903,299 B2
(45) Date of Patent: Dec. 2, 2014

(54) IMAGE FORMING APPARATUS AND A WASTE TONER RECOVERY DEVICE THEREOF

(75) Inventors: Jun Ho Lee, Seoul (KR); Myoung Sub Jang, Suwon-si (KR); Jeong Yong Ju, Hwaseong-si (KR); Byeong Hwa Ahn, Seongnam-si (KR)

(73) Assignee: Samsung Electronics Co. Ltd., Suwon (KR)

( * ) Notice: Subject to any disclaimer, the term of this patent is extended or adjusted under 35 U.S.C. 154(b) by 713 days.

(21) Appl. No.: 12/542,216

(22) Filed: Aug. 17, 2009

(65) Prior Publication Data

US 2010/0046999 A1 Feb. 25, 2010

(30) Foreign Application Priority Data

Aug. 22, 2008 (KR) ..... 10-2008-0082341

(51) Int. Cl.

| | |
|---|---|
| ***G03G 15/08*** | (2006.01) |
| ***G03G 15/20*** | (2006.01) |
| ***G03G 21/00*** | (2006.01) |
| ***G03G 21/12*** | (2006.01) |
| ***G03G 21/10*** | (2006.01) |
| ***G03G 15/16*** | (2006.01) |

(52) U.S. Cl.

CPC ..... *G03G 21/12* (2013.01); *G03G 21/105* (2013.01); *G03G 15/161* (2013.01); *G03G 2215/1661* (2013.01)

USPC ..... 399/358; 399/120; 399/123; 399/360

(58) Field of Classification Search

CPC ..... G03G 21/105; G03G 21/12

USPC ..... 399/358

See application file for complete search history.

(56) References Cited

U.S. PATENT DOCUMENTS

| | | | | |
|---|---|---|---|---|
| 5,398,098 | A * | 3/1995 | Fukunaga et al. | 399/110 |
| 5,587,769 | A * | 12/1996 | Sawada et al. | 399/113 |
| 2007/0081839 | A1 * | 4/2007 | Min et al. | 399/358 |
| 2008/0138133 | A1 * | 6/2008 | Hatayama et al. | 399/360 |
| 2009/0010694 | A1 * | 1/2009 | Jang et al. | 399/360 |

FOREIGN PATENT DOCUMENTS

| | | |
|---|---|---|
| JP | 2006-139156 | 6/2006 |

* cited by examiner

*Primary Examiner* — David Gray
*Assistant Examiner* — Andrew V Do

(57) ABSTRACT

An image forming apparatus capable of reducing a space required to install a transfer unit to achieve a compact body size. The image forming apparatus can include a body, a frame installed in the body, a transfer unit installed inside the frame, and a waste toner recovery device to recover waste toner collected from the transfer unit. The waste toner recovery device can include a first delivery unit to deliver the waste toner in a first direction, and a second delivery unit to deliver the waste toner, delivered from the first delivery unit, in a second direction. The second delivery unit can be movably installed to the frame and can be coupled to or detached from the first delivery unit via movement thereof.

22 Claims, 6 Drawing Sheets

IMAGE FORMING APPARATUS AND A WASTE TONER RECOVERY DEVICE THEREOF

CROSS-REFERENCE TO RELATED APPLICATIONS

This application claims the benefit of Korean Patent Application No. 2008-0082341, filed on Aug. 22, 2008 in the Korean Intellectual Property Office, the disclosure of which is incorporated herein by reference in its entirety.

BACKGROUND

1. Field of the Invention

The present general inventive concept relates to an image forming apparatus, and, more particularly, to an image forming apparatus having a waste toner recovery device to collect waste toner.

2. Description of the Related Art

An image forming apparatus is an apparatus to form an image on a printing medium, such as paper, according to input image signals. Examples of the image forming apparatus include printers, copiers, facsimiles, and devices combining functions thereof.

The image forming apparatus to form an image on a printing medium includes, arranged in a body defining the external appearance of the apparatus, an exposure unit to irradiate light containing image information, a developing unit to develop a visible image via the light irradiated from the exposure unit, a transfer unit to transfer the visible image developed by the developing unit to the printing medium, a fixing unit to fix the visible image on the printing medium by applying heat and pressure to the printing medium, and a discharge unit to discharge the printing medium, on which an image is completely formed, out of the body.

Recently, an image forming apparatus having a waste toner recovery device to collect waste toner accumulated on an image carrier, on which a toner image is formed, such as the transfer unit, has been disclosed. The size of the image forming apparatus is affected by a configuration of the waste toner recovery device and therefore, it is possible to appropriately select a configuration and arrangement of the waste toner recovery device, for a more compact size of the image forming apparatus.

SUMMARY

Example embodiments of the present general inventive concept provide an image forming apparatus having an improved configuration of a waste toner recovery device to achieve a more compact body size.

Additional embodiments of the present general inventive concept will be set forth in part in the description which follows and, in part, will be obvious from the description, or may be learned by practice of the general inventive concept.

Example embodiments of the present general inventive concept provide an image forming apparatus including a body, a frame installed in the body, an image carrier installed inside the frame, and a waste toner recovery device to recover waste toner collected from the image carrier, wherein the waste toner recovery device can include a first delivery unit to deliver the waste toner in a first direction, and a second delivery unit to deliver the waste toner delivered from the first delivery unit in a second direction, wherein the second delivery unit can be movably installed to the frame and can be coupled to or detached from the first delivery unit via movement thereof.

The second delivery unit may be installed at an outside of the frame.

The image forming apparatus may further include a guide rod extending in the first direction from the frame to guide movement of the second delivery unit, and a guide portion extending from the second delivery unit and formed with a guide hole to install the guide rod.

The image forming apparatus may further include a rotating cam disposed at one side of the second delivery unit to move the second delivery unit via rotation thereof.

The image forming apparatus may further include an elastic member to press the second delivery unit toward the first delivery unit.

The first delivery unit may include a delivery screw to deliver the waste toner via rotation thereof, and the second delivery unit can include a delivery belt to deliver the waste toner delivered via the delivery screw.

The second delivery unit may further include a driving pulley and a driven pulley installed at opposite inner sides of the delivery belt, and the driving pulley may be coupled with the delivery screw to receive a rotating force from the delivery screw.

The delivery screw and driving pulley may be formed with a coupling recess and a coupling protrusion, respectively, which can be coupled with each other to transmit the rotating force of the delivery screw to the driving pulley.

The image forming apparatus may further include a transfer unit including the image carrier and installed inside the frame, and the first delivery unit may deliver the waste toner collected from the transfer unit.

Example embodiments of the present general inventive concept also provide an image forming apparatus including a body, a frame installed in the body, a transfer unit installed inside the frame, and a waste toner recovery device to recover waste toner collected from the transfer unit, wherein the waste toner recovery device can include a waste toner cartridge in which the waste toner is stored, and a delivery unit movably installed between the body and the frame so as to be coupled to or separated from the transfer unit via movement thereof.

Example embodiments of the present general inventive concept can also provide a waste toner recovery device of an image forming device, including a first delivery unit disposed along a width direction of a transfer unit of the image forming device to recover waste toner therefrom, and a second delivery unit disposed at a first end of the first delivery unit perpendicular to the transfer unit to deliver the waste toner in the perpendicular direction to a storage unit via a rotational force transmitted from the first delivery unit.

The first delivery unit may include a delivery screw to transmit the rotational force to the second delivery unit.

The second delivery unit may include a delivery belt to receive the rotational force from the delivery screw and to deliver the waste toner to the storage unit.

The image forming device may include a fixing motor connected to another end of the first delivery unit to generate the rotational force of the first delivery unit.

The second delivery unit may be detachably coupled to the first delivery unit upon rotation of a cam connected to the second delivery unit.

The second delivery unit may include a driving pulley to drive the delivery belt, the driving pulley having a second delivery screw connected to the delivery screw to deliver the waste toner from the delivery screw to the delivery belt.

BRIEF DESCRIPTION OF THE DRAWINGS

These and/or other example embodiments of the present general inventive concept will become apparent and more readily appreciated from the following description of the embodiments, taken in conjunction with the accompanying drawings of which.

DETAILED DESCRIPTION OF THE EMBODIMENTS

Figure 1:
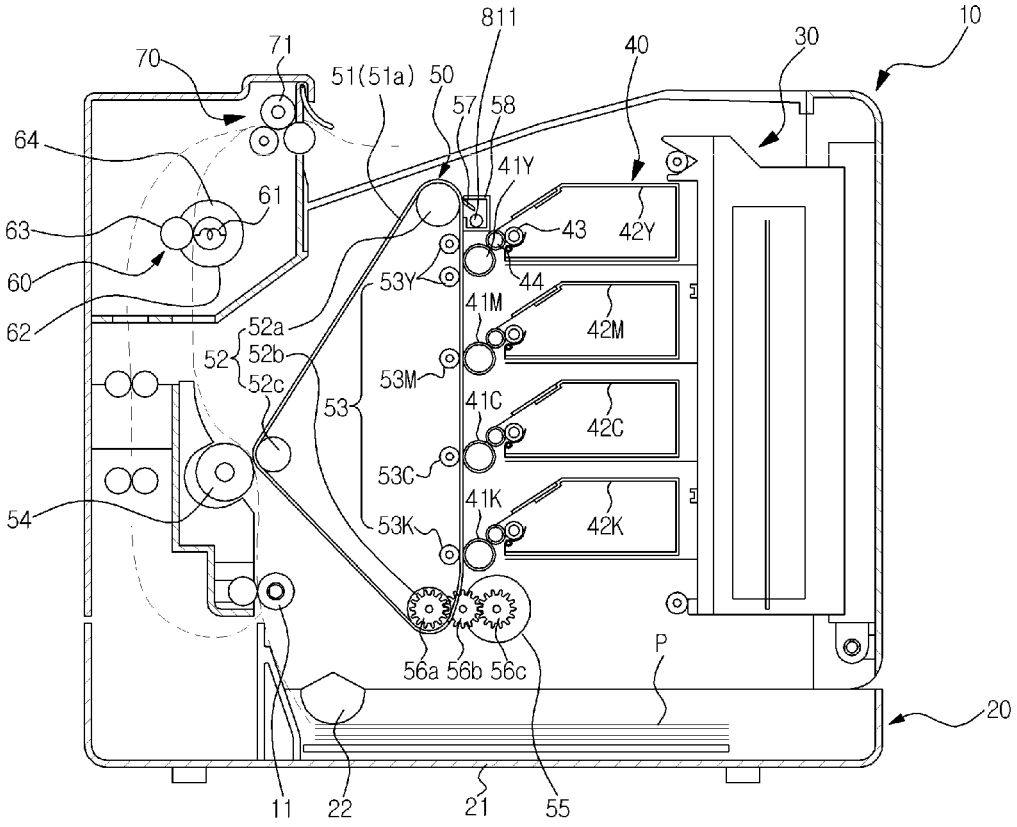
FIG. 1 is a sectional view illustrating an image forming apparatus according to an embodiment of the present general inventive concept.

Reference will now be made in detail to exemplary embodiments of the present general inventive concept, examples of which are illustrated in the accompanying drawings, wherein like reference numerals refer to the like elements throughout. The embodiments are described below to explain the present general inventive concept by referring to the figures.

As illustrated in FIG. 1, an image forming apparatus according to an example embodiment can include, arranged in a body 10 defining the external appearance of the apparatus, a feed unit 20 to supply a printing medium P such as paper, an exposure unit 30 to irradiate light containing image information, a developing unit 40 to develop a visible image via the light irradiated from the exposure unit 30, a transfer unit 50 to transfer the visible image, developed by the developing unit 40, to the printing medium P, a fixing unit 60 to fix the visible image on the printing medium P by applying heat and pressure to the printing medium P, and a discharge unit 70 to discharge the printing medium P, on which an image can be completely formed, out of the body 10.

The feed unit 20 can include a tray 21 in which the printing media P can be loaded, and a pickup roller 22 to pick up the printing media P, loaded in the tray 21, sheet by sheet. The printing medium P, picked-up by the pickup roller 22, can be delivered to the transfer unit 50 by a delivery roller 11 installed in the body 10.

The exposure unit 30 can irradiate light to photoconductors 41 of the developing unit 40 before the printing medium P enters the transfer unit 50. In the example embodiments, photoconductors 41Y, 41M, 41C and 41K can serve as image carriers on which a toner image is present. The photoconductors 41Y, 41M, 41C and 41K can correspond, respectively, to developer containers 42Y, 42M, 42C and 42K which can be arranged vertically in parallel, each of the photoconductors 41Y, 41M, 41C and 41K being formed at a surface thereof with an electrostatic latent image by the light irradiated from the exposure unit 30. However, the present general inventive concept is not limited to such arrangement, and other arrangements may be used without departing from the broader principles and spirit of the present general inventive concept.

The plurality of developer containers 42Y, 42M, 42C and 42K of the developing unit 40 can be used to receive yellow, magenta, cyan and black toners, respectively. The image forming apparatus according to an example embodiment can be of a tandem type and thus, the respective developer containers 42Y, 42M, 42C and 42K can be arranged vertically in parallel. However, the present general inventive concept is not limited to such arrangement, and other arrangements may be used without departing from the broader principles and spirit of the present general inventive concept. The respective developer containers 42Y, 42M, 42C and 42K can correspond to the respective photoconductors 41Y, 41M, 41C and 41K. Each of the developer containers 42Y, 42M, 42C and 42K can be provided with a feed roller 43 and a developing roller 44 to feed the toners to the photoconductors 41Y, 41M, 41C and 41K.

The fixing unit 60 can include a heating roller 62 in which a heater 61 is received, a press roller 63 to press the printing medium P to the heating roller 62, and a fixing motor 64 to generate and transmit a rotating force to at least one of the heating roller 62 to press roller 63 so as to rotate the roller. The printing medium P, onto which a toner image is transferred while passing through the transfer unit 50, can be delivered to the fixing unit 60. As heat and pressure are applied to the printing medium P passing between the heating roller 62 and the press roller 63 of the fixing unit 60, the toner image transferred onto the printing medium P can be fixed to the printing medium P.

The discharge unit 70 can include a discharge roller 71 to discharge the printing medium P out of the body 10 via rotation thereof. The printing medium P, having passed through the fixing unit 60, can be discharged out of the body 10 by passing through the discharge roller 71. In the present example embodiment, a rotating force from the fixing motor 64 can be transmitted to the discharge roller 71 via a plurality of discharge gears, to allow the discharge roller 71 to discharge the printing medium P via rotation thereof.

The transfer unit 50 can perform overlap transfer of the visible images on the photoconductors 41Y, 41M, 41C and 41K, to transfer a resulting overlapped image on the printing medium P. Specifically, electrostatic latent images can be formed on surfaces of the photoconductors 41Y, 41M, 41C and 41K by the exposure unit 30, and the toners can be fed to the electrostatic latent images so as to develop visible images. The visible images developed on the photoconductors 41Y, 41M, 41C and 41K can be transferred to and overlapped on an intermediate transfer member 51 which can be rotated in contact with the photoconductors 41Y, 41M, 41C and 41K so as to form a color image. The intermediate transfer member 51 can be provided as an image carrier on which the toner images are present. In the present example embodiment, the intermediate transfer member 51 can be embodied as an intermediate transfer belt 51*a*. The intermediate transfer belt 51*a*, on which the color image is formed, can transfer the image to the printing medium P, so as to form the resulting toner image on the printing medium P. The intermediate transfer belt 51*a* can be provided with a transfer motor 55 to generate a rotating force required to rotate the intermediate transfer belt 51*a*. The intermediate transfer belt 51*a* can maintain a tensile force by intermediate transfer belt rollers 52 and transfer rollers 53 and 54 during implementation of a transfer operation.

The intermediate transfer belt rollers 52 can provide the intermediate transfer belt 51*a* with a tensile force in contact with the intermediate transfer belt 51*a*. The intermediate transfer belt rollers 52 can include first, second and third intermediate transfer belt rollers 52*a*, 52*b* and 52*c*. The first, second and third intermediate transfer belt rollers 52*a*, 52*b* and 52*c* can come into outward contact with an inner surface of the intermediate transfer belt 51*a* to maintain the intermediate transfer belt 51*a* in a tightly tensioned state. In the present example embodiment, the transfer motor 55 can be connected with the third intermediate transfer belt roller 52*c* via a plurality of transfer gears 56*a*, 56*b* and 56*c*. Accordingly, as a rotating force generated from the transfer motor 55 is transmitted to the third transfer belt roller 52*c* via the transfer gears 56*a*, 56*b* and 56*c*, the intermediate transfer belt 51*a* can be rotated around the first, second and third intermediate transfer belt rollers 52*a*, 52*b* and 52*c*, so as to perform a transfer operation.

The transfer rollers 53 and 54 can include first transfer rollers 53Y, 53M, 53C and 53K to press the intermediate transfer belt 51*a* to the photoconductors 41Y, 41M, 41C and 41K, and a second transfer roller 54 in contact with the third intermediate transfer belt roller 52*c* with the intermediate transfer belt 51*a* interposed therebetween. The first transfer rollers 53Y, 53M, 53C and 53K can press the intermediate transfer belt 51*a* to the respective photoconductors 41Y, 41M, 41C and 41K, so as to transfer the visible images from the photoconductors 41Y, 41M, 41C and 41K to the intermediate transfer belt 51*a*. The second transfer roller 54 can press the intermediate transfer belt 51*a* to correspond to the third intermediate transfer belt roller 52*c*, so as to transfer the overlapped image from the intermediate transfer belt 51*a* to the printing medium P.

The transfer unit 50 further can include a cleaning blade 57 to separate waste toner remaining on the intermediate transfer belt 51*a*, and a waste toner collector 58 in which the waste toner separated by the cleaning blade 57 can be received. Accordingly, after completing the transfer of toners to the printing medium P, the waste toner remaining on the intermediate transfer belt 51*a* can be separated by the cleaning blade 57, and can be collected in the waste toner collector 58.

Figure 2:
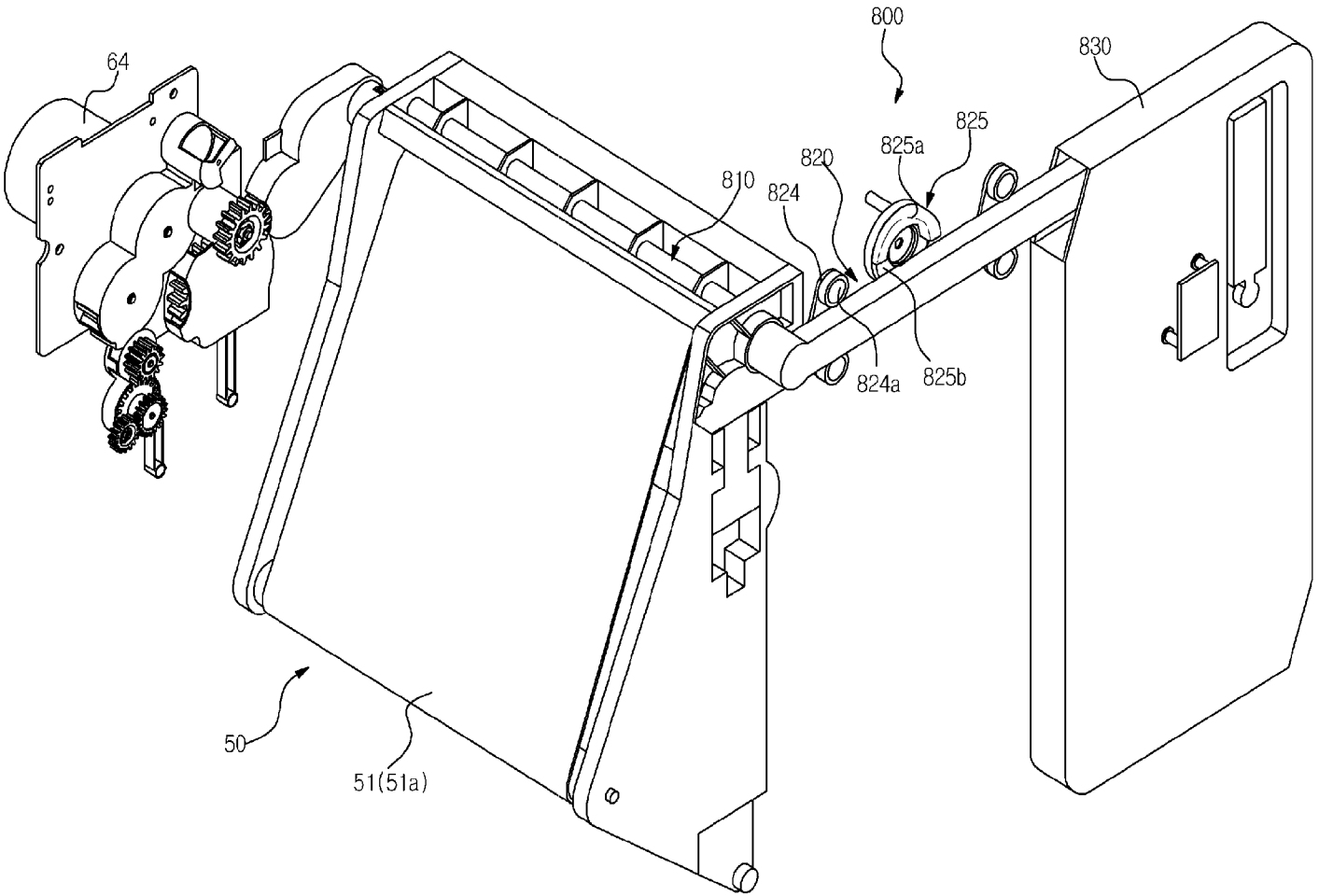
FIG. 2 is a perspective view illustrating a transfer unit and a waste toner recovery device provided in the image forming apparatus according to an embodiment of the present general inventive concept.

The image forming apparatus, as illustrated in FIG. 2, can be provided with a waste toner recovery device 800. The waste toner recovery device 800 can serve to recover the waste toner, which can be separated from the intermediate transfer belt 51*a*, as the image carrier, after completing the transfer of toners to the printing medium P in the transfer unit 50 and is collected in the waste toner collector 58. The waste toner recovery device 800 can include a first delivery unit 810, a second delivery unit 820, and a waste toner cartridge 830. The first delivery unit 810 can be installed in the waste toner collector 58 and can extend over a large distance in the same first direction as a width direction of the intermediate transfer belt 51*a*, to deliver the waste toner, collected in the waste toner collector 58, along the first direction. The second delivery unit 820 can be used to redeliver the waste toner, delivered by the first delivery unit 810, along a second direction perpendicular to the first direction. The waste toner cartridge 830 can receive the waste toner delivered by the second delivery unit 820.

Figure 3:
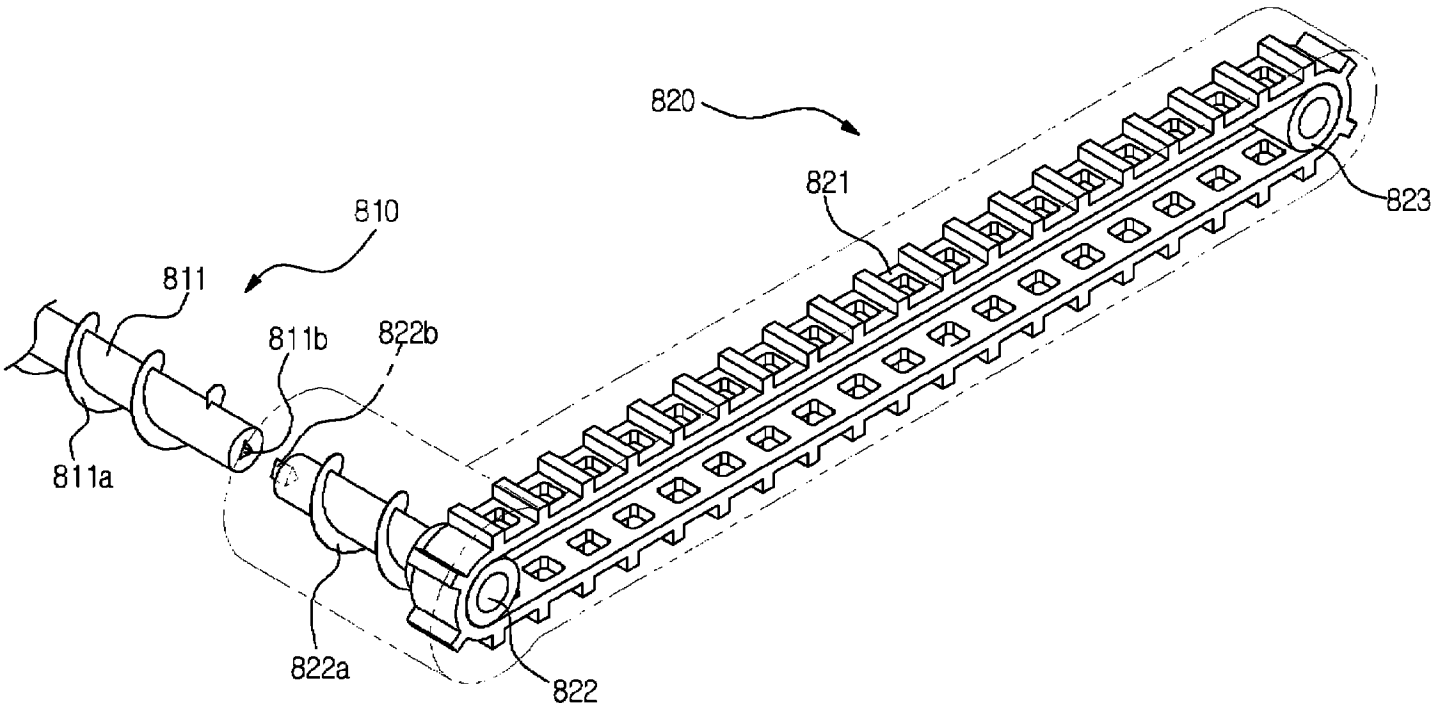
FIG. 3 is an exploded perspective view illustrating an interior configuration of the waste toner recovery device provided in the image forming apparatus according to an embodiment of the present general inventive concept.

As illustrated in FIG. 3, the first delivery unit 810 can include a delivery screw 811, which can be disposed in the waste toner collector 58 and can extend over a large distance in the first direction, to deliver the waste toner collected in the waste toner collector 58 along the first direction. The second delivery unit 820 can include a delivery belt 821 to be rotated upon receiving a rotating force transmitted via the delivery screw 811, and a driving pulley 822 and driven pulley 823 installed at opposite inner sides of the delivery belt 821 to enable rotation of the delivery belt 821. The delivery screw 811 can be formed at an outer circumference thereof with a first spiral thread 811*a*. The driving pulley 822 can be integrally formed with the delivery belt 821 to protrude laterally from the delivery belt 821 and can be formed at an outer circumference thereof with a second spiral thread 822*a* to deliver the waste toner from the first spiral thread 811*a*.

The first delivery unit 810 can be connected with the fixing motor 64, which can have less effect on the quality of an image, via a plurality of gears, to receive a rotating force from the fixing motor 64. The second delivery unit 820 can be adapted to be operated by the rotating force from the first delivery unit 810. That is, the second delivery unit 820 can be operated upon receiving the rotating force from the first delivery unit 810 without a separate drive source, enabling a more simplified configuration of the waste toner recovery device 800.

The driving pulley 822 of the second delivery unit 820 can be connected to the delivery screw 811 of the first delivery unit 810. Accordingly, the driving pulley 822 can be rotated by the rotating force transmitted through the delivery screw 811, thereby serving to rotate the delivery belt 821. To transmit the rotating force of the delivery screw 811 to the driving pulley 822, the delivery screw 811 and driving pulley 822 can be formed with a coupling recess 811*b* and a coupling protrusion 822*b* to be engaged with each other. The coupling recess 811*b* and coupling protrusion 822*b* can have corresponding shapes and can be arranged opposite each other. In the present example embodiment, the delivery screw 811 can include the indented coupling recess 811*b*, into which the coupling protrusion 822*b* can be inserted, and the driving pulley 822 can include the coupling protrusion 822*b* to be inserted into the coupling recess 811*b*.

Accordingly, as the delivery screw 811*b* is rotated upon receiving the rotating force transmitted from the fixing motor 64, the waste toner in the waste toner collector 58 can move toward the delivery belt 821 to thereby be transmitted to the delivery belt 821. If the waste toner transmitted to the delivery belt 821 is again guided to the waste toner cartridge 830 by the delivery belt 821, recovery of the waste toner from the transfer unit 50 can be completed.

Figure 4:
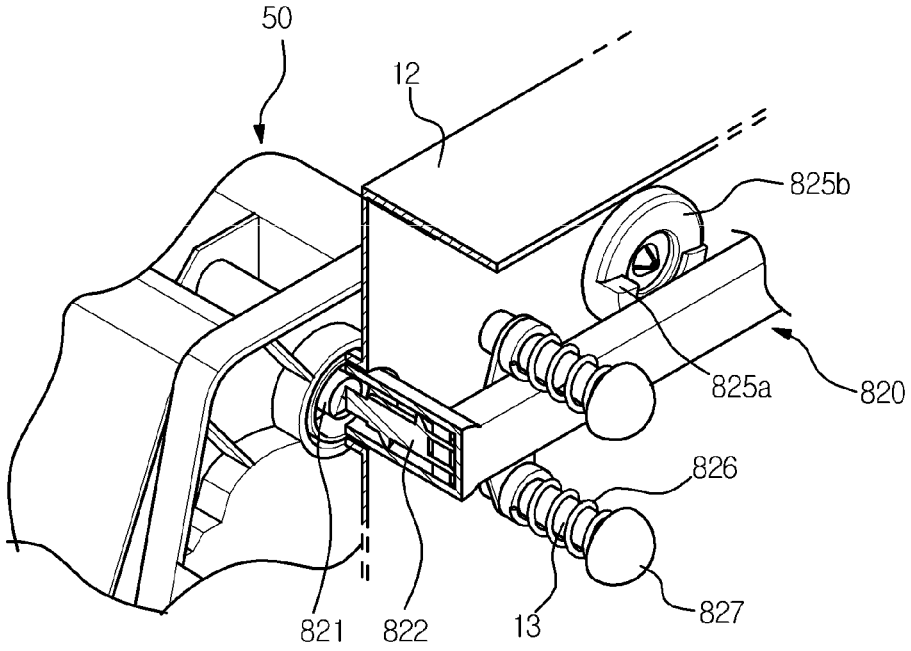
FIG. 4 is a partially sectional perspective view illustrating a coupling relationship between a first delivery unit and a second delivery unit provided in the image forming apparatus according to an embodiment of the present general inventive concept.

The first delivery unit 810 of the image forming apparatus according to the example embodiments can be installed immediately above the transfer unit 50, and the second delivery unit 820 can be installed at one end of the first delivery unit 810 so as to protrude laterally from the transfer unit 50. As illustrated in FIG. 4, a frame 12, to which the transfer unit 50, developer containers 42Y, 42M, 42C and 42K and other various elements are installed can be installed in the body 10 such that the frame 12 is spaced apart from an inner side surface of the body 10. For example, the transfer unit 50, developer containers 42Y, 42M, 42C and 42K and the like may be installed inside the frame 12, and a variety of elements may be installed in a space between the body 10 and the frame 12.

Accordingly, in the case where the transfer unit 50 is installed in a space inside the frame 12 in a state wherein the second delivery unit 820 is coupled to the first delivery unit 810 that is in turn coupled to the transfer unit 50 to allow the second delivery unit 820 to be introduced into the space inside the frame 12, it may be possible to provide an additional space to introduce the second delivery unit 820 at a lateral side of the transfer unit 50. This can consequently be provided by an increase in a width of the body 10.

In the image forming apparatus according to example embodiments of the present general inventive concept, the second delivery unit 820 can be detachably coupled to the first delivery unit 810 in a space between the body 10 and the frame 12 to achieve a compact size of the body 10.

For example, the second delivery unit 820 can be installed in a space between the body 10 and the frame 12, and the transfer unit 50, to which the first delivery unit 810 is installed, can be installed in a space inside the frame 12. With this configuration, no space for installation of the second delivery unit 820 inside the frame 12 is required, and consequently, the body 10 can achieve a more compact size.

In the present example embodiment, the second delivery unit 820 can be movable in the same first direction as a longitudinal direction of the first delivery unit 810 such that it can be coupled to or detached from the first delivery unit 810 via movements thereof in the first direction. For this, the frame 12 can be integrally formed with guide rods 13 extending in the first direction, and the second delivery unit 820 can be movably installed to the guide rods 13. The second delivery unit 820 can have guide portions 824 having guide holes 824*a* to enable movable installation of the guide rods 13. For example, plural pairs of upper and lower guide rods 13 can be spaced apart from one another in the second direction, and a plurality of guide portions 824 can extend upward and downward from the second delivery unit 820 to correspond to the guide rods 13.

To move the second delivery unit 820 in the first direction, a rotating cam 825 can be rotatably installed in the body 10, for example, to the frame 12, to move the second delivery unit 820 in the first direction. The rotating cam 825 can be formed at a surface thereof with cam faces 825*a* and 825*b* and can include a mount portion 825*a* and a valley portion 825*b* which can be circumferentially spaced apart from each other and can be connected to each other via a slope. One side of the second delivery unit 820 can be supported at the cam faces 825*a* and 825*b*. Accordingly, the second delivery unit 820 can be reciprocally moved in the first direction as it is moved along the cam faces 825*a* and 825*b* according to a rotation of the rotating cam 825. The rotating cam 825 can be integrally formed with a lever (825*c*, See FIG. 5) for easy transmission of an external force.

Each guide rod 13 can be installed with an elastic member 826 to press the second delivery unit 820 toward the first delivery unit 810. In the present example embodiment, the elastic member 826 can be a coil spring provided at the exterior of the guide rod 13. Accordingly, as one end of the elastic member 826 is supported by a bolt 827 fastened to a tip end of the guide rod 13 and the other end of the elastic member 826 is supported by the guide portion 824, the second delivery unit 820 can be elastically supported toward the first delivery unit 810.

Figure 5:
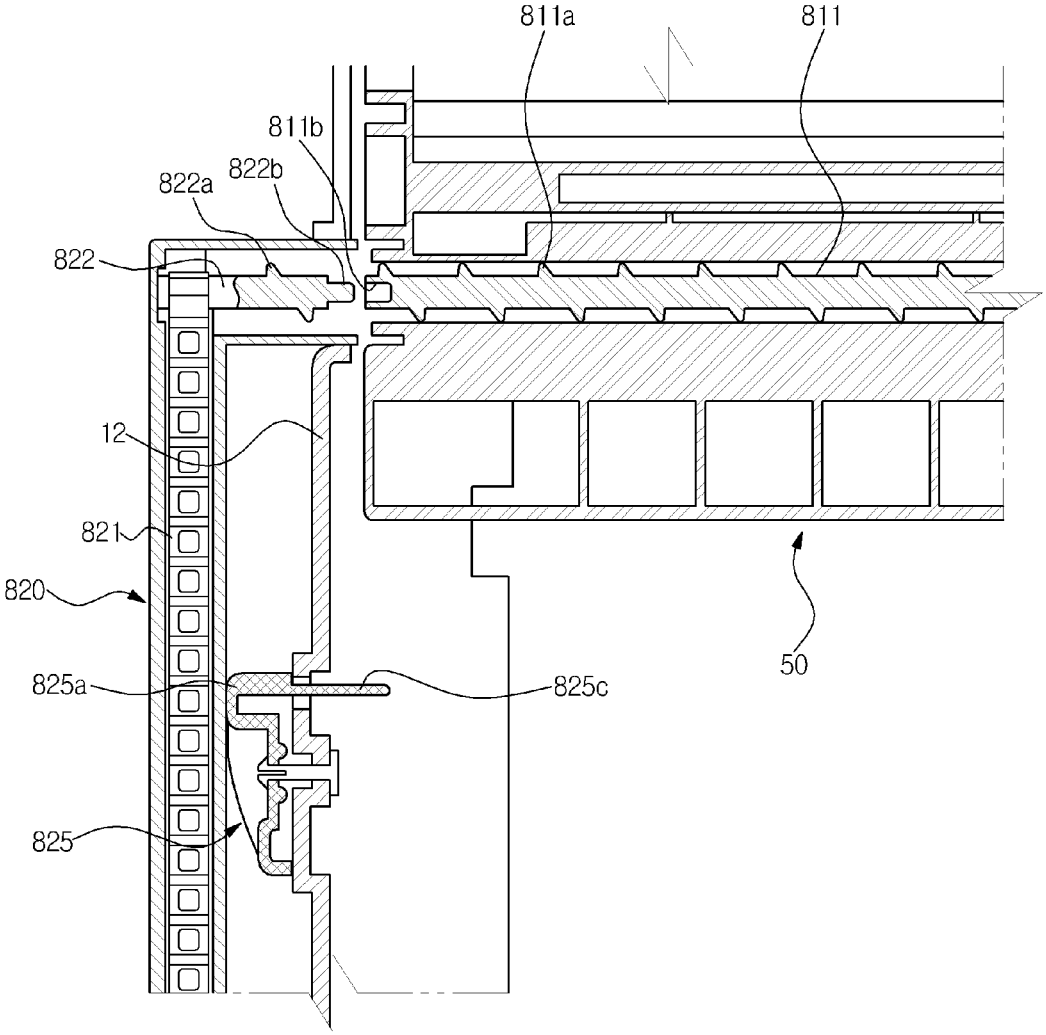
FIGS. 5 and 6 are sectional views illustrating coupling/separating operations of the first delivery unit provided in the image forming apparatus according to an embodiment of the present general inventive concept.
Figure 6:
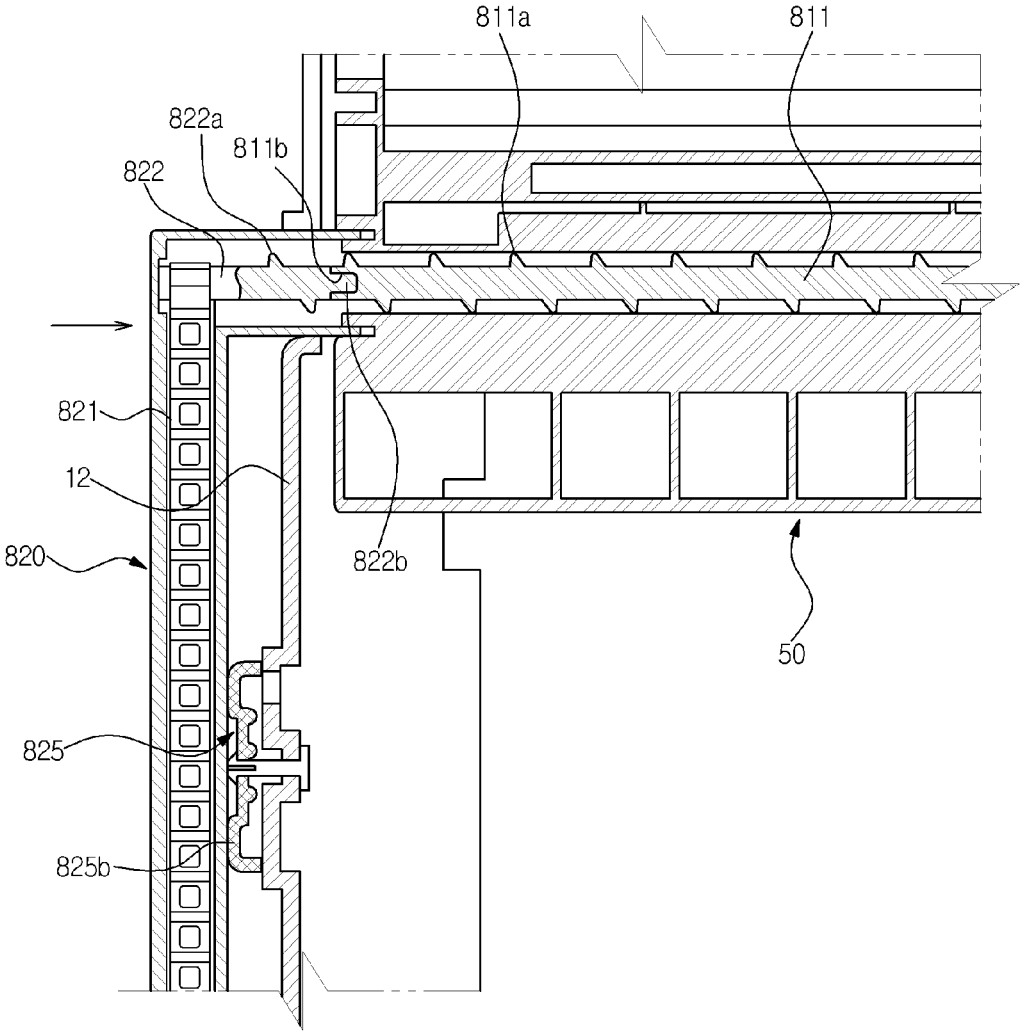

Accordingly, prior to installing the transfer unit 50, as illustrated in FIG. 5, to allow the transfer unit 50 to be introduced into a space inside the frame 12, the second delivery unit 820 can be supported by the mount portion 825*a* of the cam faces 825*a* and 825*b* of the rotating cam 825. Thereby, the second delivery unit 820 can be kept at a laterally moved position. Thereafter, if the second delivery unit 820 is supported by the valley portion 825*b* of the cam faces 825*a* and 825*b* of the rotating cam 825 as illustrated in FIG. 6 as the rotating cam 825 can be rotated after completing the installation of the transfer unit 50, the second delivery unit 820 can be moved toward the first delivery unit 810 by an elastic force of the elastic member 826. Thereby, the coupling protrusion 822*a* which is formed at the driving pulley 822 of the second delivery unit 820 can be coupled into the coupling recess 811*b* formed in the delivery screw 811 of the first delivery unit 810, allowing the second delivery unit 820 to receive a rotating force from the first delivery unit 810.

Although the image forming apparatus of the present general inventive concept is designed to recover the waste toner collected from the intermediate transfer belt 51*a* by use of the waste toner recovery device 800, the present general inventive concept is not limited thereto, and can also be applicable to other image forming apparatuses, for example, wherein the toner is directly transferred from a photoconductor to a printing medium such that waste toner collected from the photoconductor can be recovered via a waste toner recovery device.

As is apparent from the above description, an image forming apparatus according to an example embodiment can have an enhanced space utility by virtue of a waste toner recovery device configured as described above, resulting in a compact body size.

Although a few example embodiments of the present general inventive concept have been illustrated and described, it will be appreciated by those skilled in the art that changes may be made in these example embodiments without departing from the principles and spirit of the general inventive concept, the scope of which is defined in the claims and their equivalents.

What is claimed is:

1. An image forming apparatus, comprising:

a body;

at least one photoconductor to develop an image with toner;

a transfer unit installed inside a frame and to receive the image with the toner from the at least one photoconductor, the frame being installed in the body; and a waste toner recovery device to recover waste toner from the transfer unit, the waste toner recovery device comprising:

a first delivery unit installed at an inner side of the frame and to deliver the waste toner in a first direction, and a second delivery unit to deliver the waste toner, delivered from the first delivery unit, in a second direction, the second delivery unit being movably installed to the frame and being coupled to or detached from the first delivery unit via movement of the second delivery unit, the second delivery unit being installed at an outer side of the frame opposite the inner side, the frame extending substantially parallel to the second delivery unit.

2. The apparatus of claim 1, wherein developer containers are installed at an inside portion of the frame.

3. An image forming apparatus, comprising:

a body;

at least one photoconductor to develop an image with toner;

a transfer unit installed inside a frame and to receive the image with the toner from the at least one photoconductor, the frame being installed in the body;

a waste toner recovery device to recover waste toner from the transfer unit, the waste toner recovery device including:

a first delivery unit to deliver the waste toner in a first direction, and a second delivery unit to deliver the waste toner, delivered from the first delivery unit, in a second direction, the second delivery unit being movably installed to the frame and being coupled to or detached from the first delivery unit via movement thereof, the second delivery unit being installed at an outside of the frame;

a guide rod extending in the first direction from the frame to guide movement of the second delivery unit; and a guide portion extending from the second delivery unit and formed with a guide hole to enable installation of the guide rod.

4. The apparatus of claim 3, further comprising:

a rotating cam disposed at one side of the second delivery unit to move the second delivery unit via rotation thereof.

5. The apparatus of claim 4, further comprising:

an elastic member to press the second delivery unit toward the first delivery unit.

6. The apparatus of claim 4, wherein the rotating cam includes a mount portion and a valley portion, the mount portion being thicker than the valley portion.

7. The apparatus of claim 6, wherein the rotating cam is rotated to contact the second delivery unit with the mount portion to detach the second delivery unit from the first delivery unit.

8. The apparatus of claim 7, wherein the rotating cam is rotated to contact the second delivery unit with the valley portion to couple the second delivery unit with the first delivery unit.

9. An image forming apparatus, comprising:

a body;

at least one photoconductor to develop an image with toner;

a transfer unit installed inside a frame and to receive the image with the toner from the at least one photoconductor, the frame being installed in the body; and a waste toner recovery device to recover waste toner from the transfer unit, the waste toner recovery device comprising:

a first delivery unit installed at an inner side of the frame and to deliver the waste toner in a first direction, and a second delivery unit to deliver the waste toner, delivered from the first delivery unit, in a second direction, the second delivery unit being movably installed to the frame and being coupled to or detached from the first delivery unit via movement of the second delivery unit, the second delivery unit being installed at an outer side of the frame opposite the inner side, the frame extending substantially parallel to the second delivery unit, wherein:

the first delivery unit includes a delivery screw to deliver the waste toner via rotation thereof; and the second delivery unit includes a delivery belt to deliver the waste toner delivered via the delivery screw.

10. The apparatus of claim 9, wherein:

the second delivery unit further includes a driving pulley and a driven pulley installed at opposite inner sides of the delivery belt; and the driving pulley is coupled with the delivery screw to receive a rotating force from the delivery screw.

11. The apparatus of claim 10, wherein the delivery screw and driving pulley are formed with a coupling recess and a coupling protrusion, respectively, which are coupled with each other to transmit the rotating force of the delivery screw to the driving pulley.

12. An image forming apparatus comprising:

a body;

at least one photoconductor to develop an image with toner;

a transfer unit installed inside a frame and to receive the image with the toner from the at least one photoconductor, the frame installed in the body; and a waste toner recovery device to recover waste toner from the transfer unit, the waste toner recovery device comprising:

a waste toner cartridge in which the waste toner is stored, a first delivery unit installed at an inner side of the frame to deliver the waste toner in a first direction, and a second delivery unit movably installed at an outer side of the frame opposite the inner side so as to be coupled to or separated from the transfer unit via movement of the second delivery unit, the frame extending substantially parallel to the second delivery unit.

13. An image forming apparatus comprising:

a body;

at least one photoconductor to develop an image with toner;

a transfer unit installed inside a frame and to receive the image with the toner from the at least one photoconductor, the frame installed in the body; and a waste toner recovery device to recover waste toner from the transfer unit, the waste toner recovery device comprising:

a waste toner cartridge in which the waste toner is stored, and a delivery unit movably installed between the body and the frame so as to be coupled to or separated from the transfer unit via movement of the delivery unit, wherein the delivery unit comprises:

a first delivery unit installed at an inner side of the frame and including a delivery screw to deliver the waste toner via rotation thereof; and a second delivery unit having a delivery belt to deliver the waste toner delivered via the delivery screw, the second delivery unit being disposed at an outer side of the frame opposite the inner side, the frame extending substantially parallel to the second delivery unit.

14. The apparatus of claim 13, further comprising:

a guide rod extending in a first direction from the frame to guide movement of the second delivery unit; and a guide portion extending from the second delivery unit and formed with a guide hole to enable installation of the guide rod.

15. The apparatus of claim 13, further comprising:

a rotating cam disposed at one side of the second delivery unit to move the second delivery unit via rotation thereof.

16. The apparatus of claim 13, further comprising:

an elastic member to press the second delivery unit toward the first delivery unit.

17. A waste toner recovery device of an image forming device, the waste toner recovery device comprising:

a first delivery unit disposed along a width direction of a transfer unit of the image forming device to recover from the transfer unit waste toner left on the transfer unit after transferring a toner image from the transfer unit to a recording medium, the first delivery unit and the transfer unit being disposed inside a frame; and a second delivery unit movably disposed outside the frame at a first end of the first delivery unit perpendicular to the width direction to deliver the waste toner in the perpendicular direction to a storage unit via a rotational force transmitted from the first delivery unit, the second delivery unit protruding laterally in the width direction from the transfer unit, and coupling or detaching from the first delivery unit via movement of the second delivery unit relative to the frame.

18. The waste toner recovery device of claim 17, wherein the first delivery unit comprises a delivery screw to transmit the rotational force to the second delivery unit.

19. The waste toner recovery device of claim 18, wherein the second delivery unit comprises a delivery belt to receive the rotational force from the delivery screw and to deliver the waste toner to the storage unit.

20. A waste toner recovery device of an image forming device, the waste toner recovery device comprising:

a first delivery unit disposed along a width direction of a transfer unit of the image forming device to recover from the transfer unit waste toner left on the transfer unit after transferring a toner image from the transfer unit to a recording medium; and a second delivery unit disposed at a first end of the first delivery unit perpendicular to the width direction to deliver the waste toner in the perpendicular direction to a storage unit via a rotational force transmitted from the first delivery unit, the second delivery unit protruding laterally in the width direction from the transfer unit, wherein the image forming device includes a fixing motor connected to another end of the first delivery unit to generate the rotational force of the first delivery unit.

21. A waste toner recovery device of an image forming device, the waste toner recovery device comprising:

a first delivery unit disposed along a width direction of a transfer unit of the image forming device to recover from the transfer unit waste toner left on the transfer unit after transferring a toner image from the transfer unit to a recording medium; and a second delivery unit disposed at a first end of the first delivery unit perpendicular to the width direction to deliver the waste toner in the perpendicular direction to a storage unit via a rotational force transmitted from the first delivery unit, the second delivery unit protruding laterally in the width direction from the transfer unit, wherein:

the first delivery unit comprises a delivery screw to transmit the rotational force to the second delivery unit; and the second delivery unit is detachably coupled to the first delivery unit upon rotation of a cam connected to the second delivery unit.

22. The waste toner recovery device of claim 21, wherein the second delivery unit comprises a driving pulley to drive the delivery belt, the driving pulley having a second delivery screw connected to the delivery screw to deliver the waste toner from the delivery screw to the delivery belt.

* * * * *